US009346265B2

(12) United States Patent
Tanase et al.

(10) Patent No.: US 9,346,265 B2
(45) Date of Patent: May 24, 2016

(54) LIQUID DISCHARGING APPARATUS AND LIQUID DISCHARGING METHOD

(71) Applicant: SEIKO EPSON CORPORATION, Tokyo (JP)

(72) Inventors: Kazuyoshi Tanase, Matsumoto (JP); Toru Takahashi, Azumino (JP); Hiroshi Wada, Azumino (JP); Takamitsu Kondo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 67 days.

(21) Appl. No.: 14/222,094

(22) Filed: Mar. 21, 2014

(65) Prior Publication Data

US 2014/0292861 A1 Oct. 2, 2014

(30) Foreign Application Priority Data

Mar. 29, 2013 (JP) ..... 2013-071624

(51) Int. Cl.
*B41J 29/38* (2006.01)
*B41J 2/07* (2006.01)
*B41J 2/21* (2006.01)

(52) U.S. Cl.
CPC *B41J 2/07* (2013.01); *B41J 2/2114* (2013.01); *B41J 2/2121* (2013.01); *B41J 2/2146* (2013.01); *B41J 2202/20* (2013.01); *B41J 2202/21* (2013.01)

(58) Field of Classification Search
CPC ..... B41J 2/0458; B41J 2/2128; B41J 2/2054; B41J 2/2056; B41J 2/07
USPC ..... 347/141, 15, 45, 13
See application file for complete search history.

(56) References Cited

U.S. PATENT DOCUMENTS

| | | | | |
|---|---|---|---|---|
| 7,726,767 | B2 * | 6/2010 | Noguchi et al. | 347/19 |
| 2003/0085939 | A1 * | 5/2003 | Koitabashi et al. | 347/15 |
| 2005/0116983 | A1 * | 6/2005 | Wada et al. | 347/19 |
| 2006/0017761 | A1 * | 1/2006 | Matsuzawa et al. | 347/15 |
| 2007/0165068 | A1 * | 7/2007 | Tsuboi | 347/41 |
| 2009/0167805 | A1 * | 7/2009 | Mizutani | 347/15 |
| 2009/0225121 | A1 * | 9/2009 | Miyamoto | B41J 2/2132 347/15 |
| 2011/0148966 | A1 * | 6/2011 | Yoshida et al. | 347/14 |
| 2011/0316921 | A1 * | 12/2011 | Azuma et al. | 347/15 |
| 2012/0026227 | A1 * | 2/2012 | Tanaka et al. | 347/9 |
| 2012/0212534 | A1 * | 8/2012 | Tanase et al. | 347/15 |
| 2012/0218335 | A1 * | 8/2012 | Kondo | B41J 2/2146 347/13 |

FOREIGN PATENT DOCUMENTS

JP 2008-143065 6/2008

* cited by examiner

*Primary Examiner* — Matthew Luu
*Assistant Examiner* — Patrick King
(74) *Attorney, Agent, or Firm* — Workman Nydegger

(57) ABSTRACT

There is provided a liquid discharging apparatus including: a first nozzle row and a second nozzle row in which nozzles for discharging liquid are lined up in a predetermined direction; and a control unit, in which the control unit, when a value of the input data of the image is at least in a partial range, obtains a corrected discharging rate which is a discharging rate smaller than a discharging rate in the non-overlapped region with respect to the value of the input data at least in the partial range of the input data, and discharges the liquid from the nozzles of the first nozzle row and the second nozzle row depending on the corrected discharging rate, and a predetermined recording duty which is a recording duty higher than a recording duty in the non-overlapped region, in the overlapped region.

7 Claims, 17 Drawing Sheets

FIG. 10

| INPUT GRADATION VALUE IN OVERLAPPED REGION (% DISPLAY) | 10 | 20 | 30 | 40 | 50 | 60 | 70 | 80 | 90 | 100 |
|---|---|---|---|---|---|---|---|---|---|---|
| INCREASED AMOUNT IN OVERLAPPED REGION A1 | A | A | A | A | B | C | C | C | C | C |
| INCREASED AMOUNT IN OVERLAPPED REGION A2 | A | A | A | A | A | B | C | C | C | C |
| INCREASED AMOUNT IN OVERLAPPED REGION A3 | A | A | A | A | A | B | C | C | C | C |
| INCREASED AMOUNT IN OVERLAPPED REGION A4 | A | A | A | A | A | B | C | C | C | C |
| INCREASED AMOUNT IN OVERLAPPED REGION A5 | A | A | A | A | A | A | B | C | C | C |
| INCREASED AMOUNT IN OVERLAPPED REGION A6 | A | A | A | A | A | A | A | C | C | C |
| INCREASED AMOUNT IN OVERLAPPED REGION A7 | A | A | A | A | B | C | A | A | C | B |
| INCREASED AMOUNT IN OVERLAPPED REGION A8 | A | A | A | A | C | C | C | A | A | A |

A1 < A2 < A3 < A4 < A5 < A6 < A7 < A8

LIQUID DISCHARGING APPARATUS AND LIQUID DISCHARGING METHOD

BACKGROUND

1. Technical Field

The present invention relates to a liquid discharging apparatus and a liquid discharging method.

2. Related Art

An ink jet type printer for discharging ink to a medium to form an image has been developed. In such printers, there is a line head type printer which can form an image over the entire surface of the medium in a width direction by lining a plurality of nozzle rows in a direction intersecting with a transportation direction of the medium.

JP-A-2008-143065 discloses a technology of setting a total recording duty of recording elements in an overlapped portion to be higher than a recording duty of recording elements which are not in an overlapped portion.

In such a line head printer, an overlapped region of the nozzle rows is affected by an error due to an installation error of a head or a transportation error of a medium, and deviation of landing locations of ink discharged by an upstream nozzle and ink discharged by a downstream nozzle occurs. If such deviation of the landing locations occurs, a difference in gloss between the overlapped region and a non-overlapped region occurs, and lines may be noticed. Such a difference in gloss is not desirable and therefore the difference in gloss is required to be decreased as much as possible. That is, it is desirable to decrease the difference in gloss of an image between the overlapped region and the non-overlapped region of the nozzle rows.

SUMMARY

An advantage of some aspects of the invention is to decrease a difference in gloss of an image between an overlapped region and a non-overlapped region of nozzle rows.

According to an aspect of the invention, there is provided a liquid discharging apparatus including: a first nozzle row in which nozzles for discharging liquid are lined up in a predetermined direction; a second nozzle row in which nozzles for discharging liquid are lined up in a predetermined direction, and which is disposed by forming an overlapped region in which an end portion of one side in the predetermined direction is overlapped with an end portion of the other side in the predetermined direction of the first nozzle row; and a control unit which discharges liquid from nozzles in the overlapped region and a non-overlapped region which is a region other than the overlapped region, depending on a discharging rate of liquid acquired based on input data of an image, and a recording duty for discharging the liquid, in which the control unit, when a value of the input data of the image is at least in a partial range, obtains a corrected discharging rate which is a discharging rate smaller than a discharging rate in the non-overlapped region with respect to the value of the input data at least in the partial range of the input data, and discharges the liquid from the nozzles of the first nozzle row and the second nozzle row depending on the corrected discharging rate, and a predetermined recording duty which is a recording duty higher than a recording duty in the non-overlapped region, in the overlapped region.

Other aspects of the invention will be clear with the specification and accompanying drawings.

BRIEF DESCRIPTION OF THE DRAWINGS

The invention will be described with reference to the accompanying drawings, wherein like numbers reference like elements.

FIG. 10 is a table showing quality of an image in an overlapped region.

DESCRIPTION OF EXEMPLARY EMBODIMENTS

Figure 1:
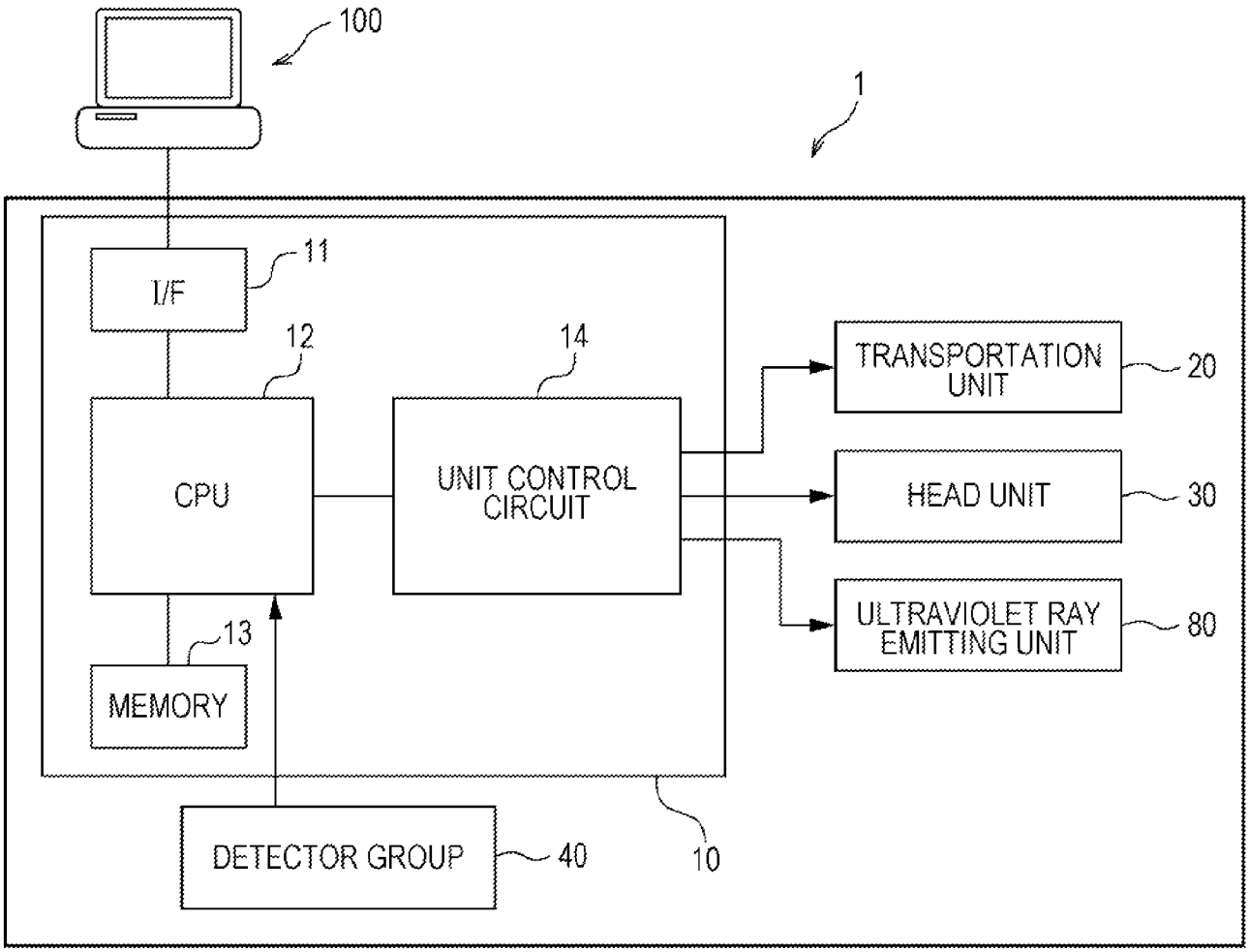
FIG. 1 is a block diagram of all configurations of a printer.

At least the following aspects will be made clear with the specification and the accompanying drawings. That is, there is provided a liquid discharging apparatus including: a first nozzle row in which nozzles for discharging liquid are lined up in a predetermined direction; a second nozzle row in which nozzles for discharging liquid are lined up in a predetermined direction, and which is disposed by forming an overlapped region in which an end portion of one side in the predetermined direction is overlapped with an end portion of the other side in the predetermined direction of the first nozzle row; and a control unit which discharges liquid from nozzles in the overlapped region and a non-overlapped region which is a region other than the overlapped region, depending on a discharging rate of liquid acquired based on input data of an image, and a recording duty for discharging the liquid, in which the control unit, when a value of the input data of the image is at least in a partial range, obtains a corrected discharging rate which is a discharging rate smaller than a discharging rate in the non-overlapped region with respect to the value of the input data at least in the partial range of the input data, and discharges the liquid from the nozzles of the first nozzle row and the second nozzle row depending on the corrected discharging rate, and a predetermined recording duty which is a recording duty higher than a recording duty in the non-overlapped region, in the overlapped region.

By doing so, it is possible to acquire the corrected discharging rate which is smaller than that in the non-overlapped region at least in a partial range of the input data, and to adjust an increased amount of a discharging amount of the liquid based on the corrected discharging rate and the predetermined recording duty in the overlapped region. It is possible to improve a filled degree of the liquid at the time of using a specific input gradation value which is difficult to be improved when the predetermined recording duty is fixed, and thus it is possible to decrease a difference in gloss between the images in the overlapped region or the non-overlapped region of the nozzle rows.

In the liquid discharging apparatus, it is desirable that the predetermined recording duty be constant regardless of the value of the input data.

As described above, although there is a restriction in which the predetermined recording duty cannot be changed, it is possible to improve the filled degree of the liquid at the time of using the specific input gradation value to decrease the difference in gloss between the images in the overlapped region or the non-overlapped region of the nozzle rows according to the configuration described above.

It is desirable that the nozzles discharge a plurality of sizes of liquid droplets to form dots with a plurality of dot sizes, and the corrected discharging rate correspond to an amount related to a dot generation rate for each dot size.

By doing so, it is possible to discharge the plurality of sizes of droplets based on the dot generation rate for each dot size.

When further decreasing the discharging rate in the overlapped region than that in the non-overlapped region at least in a partial range of the input data, it is desirable to further decrease the dot generation rate for each dot size in the overlapped region than that in the non-overlapped region at least in a partial range of the input data.

By doing so, it is possible to decrease the dot generation rate for each dot size to acquire the corrected discharging rate in a case of discharging the plurality sizes of liquid droplets.

It is desirable to discharge the liquid from the nozzles based on dot data obtained by acquiring the corrected dot generation rate by multiplying the recording duty of the nozzles by the dot generation rate for each dot size and performing a half-tone process with respect to the acquired corrected dot generation rate.

By doing so, it is possible to specify a dot generation location by performing the half-tone process and discharge the liquid.

It is desirable to use a mask having a blue noise property or a green noise property as a dither mask of the half-tone process.

By doing so, it is possible to cause the difference in gloss between the images in the overlapped region and the non-overlapped region not to be noticed, by applying the dither mask considering human visual characteristics.

It is desirable that the discharging rate before acquiring the corrected discharging rate in the overlapped region be the discharging rate acquired by multiplying a predetermined coefficient by the discharging rate in the non-overlapped region.

By doing so, it is possible to increase the amount of the liquid in the overlapped region to improve the filled degree of the liquid.

In addition, at least the following aspect also will be made clear with the specification and the accompanying drawings. That is, there is provided a liquid discharging method for discharging liquid from a liquid discharging apparatus including a first nozzle row in which nozzles for discharging liquid are lined up in a predetermined direction, and a second nozzle row in which nozzles for discharging liquid are lined up in a predetermined direction, and which is disposed by forming an overlapped region in which an end portion of one side in the predetermined direction is overlapped with an end portion of the other side in the predetermined direction of the first nozzle row, the method including: receiving input data of an image; when a value of the input data of the image is at least in a partial range, obtaining a corrected discharging rate which is a discharging rate smaller than a discharging rate in the non-overlapped region with respect to the value of the input data at least in the partial range of the input data; and discharging the liquid from the nozzles of the first nozzle row and the second nozzle row depending on the corrected discharging rate, and a predetermined recording duty which is a recording duty higher than a recording duty in the non-overlapped region, in the overlapped region.

By doing so, it is possible to acquire the corrected discharging rate which is smaller than that in the non-overlapped region at least in a partial range of the input data, and to adjust an increased amount of a discharging amount of the liquid based on the corrected discharging rate and the predetermined recording duty in the overlapped region. It is possible to improve the filled degree of the liquid at the time of using the specific input gradation value which is difficult to be improved when the predetermined recording duty is fixed, and thus it is possible to decrease the difference in gloss between the images in the overlapped region or the non-overlapped region of the nozzle rows.

System Configuration

The embodiment will be described using an apparatus having a printing system in which a line head printer (hereinafter, printer 1) from ink jet printers and a computer 100 are connected to each other, as the liquid discharging apparatus.

Figure 2:
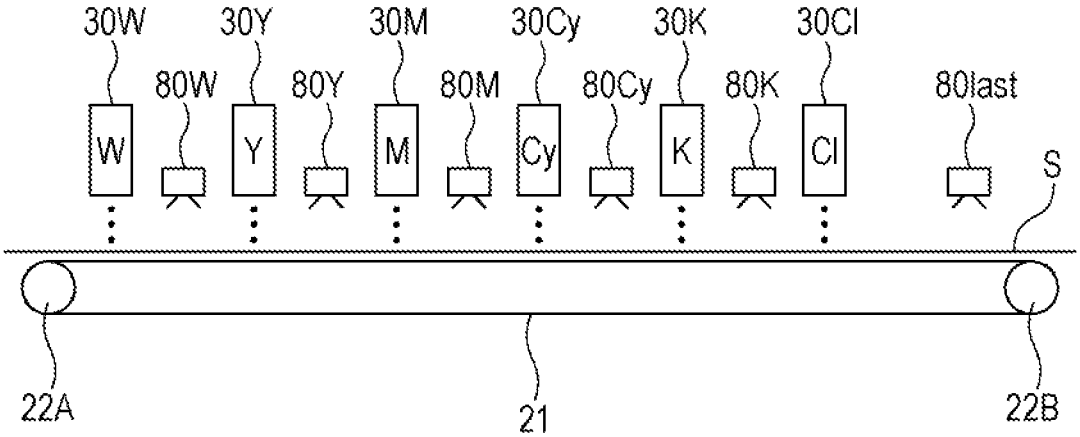
FIG. 2 is a schematic side view of a printer.

FIG. 1 is a block diagram of all configurations of the printer 1 and FIG. 2 is a schematic side view of the printer 1. The printer 1 which receives printing data from the computer 100 which is an external device, controls each unit (transportation unit 20, head unit 30, and ultraviolet ray emitting unit 80) with a controller 10 and prints an image on a sheet S. In addition, a detector group 40 monitors a state in the printer 1 and the controller 10 controls each unit based on this detected result.

The controller 10 is a control unit for controlling the printer 1. An interface unit 11 is for performing transmitting and receiving data between the computer 100 which is an external device and the printer 1. A CPU 12 is an arithmetic processing unit for performing overall control of the printer 1. A memory 13 is for securing an area for storing a program or a work area of the CPU 12. The CPU 12 controls each unit with a unit control circuit 14 according to the program stored in the memory 13. In the embodiment, the computer 100 is provided as an external device, but may be included in the printer 1 as an internal device.

The transportation unit 20 includes a transportation belt 21 and transportation rollers 22A and 22B, sends the sheet S to printable location, and transports the sheet S in a transportation direction at a predetermined transportation speed. The sheet S is fed onto the transportation belt 21, and the sheet S on the transportation belt 21 is transported by rotating the transportation belt 21 by the transportation rollers 22A and 22B. Electrostatic adsorption or vacuum adsorption of the sheet S on the transportation belt 21 may be performed from a lower side.

In FIG. 2, a white ink head unit 30W, a yellow ink head unit 30Y, a magenta ink head unit 30M, a cyan ink head unit 30Cy, a black ink head unit 30K, and a clear ink head unit 30Cl are disposed from an upstream side of the sheet S in the transportation direction. In a case where an ink color is not particularly specified, only reference numeral "30" is denoted for the entire head units.

The head unit 30 is for discharging ink droplets to the sheet S and includes a plurality of heads 31. The plurality of nozzles which are ink discharging units are provided on lower surfaces of the heads 31. A pressure chamber (not shown) in which the ink is accommodated, and a driving element (piezoelectric element) for changing capacitance of the pressure chamber to discharge the ink are provided in each nozzle.

In the embodiment, the ink filled in the head unit 30 is ultraviolet curable ink (UV ink).

The printer 1 includes corresponding ultraviolet ray emitting units 80W, 80Y, 80M, 80Cy, and 80K on a downstream side of the head unit 30 excluding the clear ink head unit 30Cl. The ultraviolet ray emitting units are for temporarily curing the ink landed on the sheet S. An ultraviolet ray emitting unit 80last is included on the most downstream side. The ultraviolet ray emitting unit 80last is for completely curing the ink landed on the sheet S. The temporary curing is the curing of the surface of the ink droplet so that the ink on the sheet S does not flow, and the complete curing is the curing of the inside of the ink on the sheet S.

In the printer 1, when the controller 10 receives the printing data, the controller 10 first sends the sheet S to an upper portion of the transportation belt 21. After that, the sheet S is transported on the transportation belt 21 at a constant speed without stopping and faces nozzle surfaces of the heads 31. The ink droplets are intermittently discharged from each nozzle based on the image data while the sheet S is transported under the head unit 30. As a result, a dot row (hereinafter, also referred to as a "raster line") along the transportation direction is formed on the sheet S and the image is printed. The image data is configured from a plurality of pixels disposed two-dimensionally, and each pixel (data) indicates whether or not to form the dot in a region (pixel region) on a medium corresponding to each pixel.

Nozzle Disposition

Figure 3:
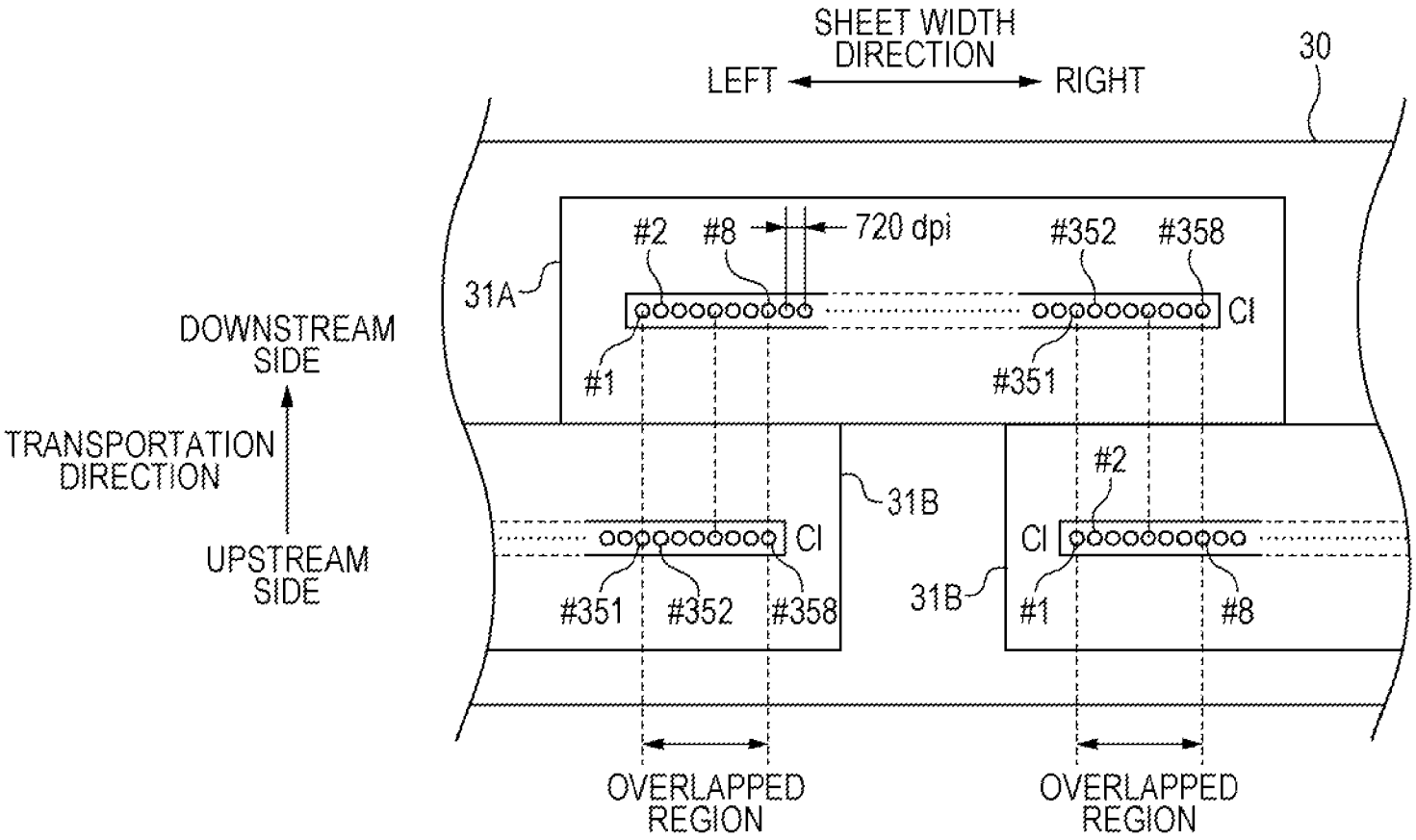
FIG. 3 is a diagram showing nozzle arrangement of a lower surface of a head unit.

FIG. 3 is a diagram showing nozzle arrangement of a lower surface of the head unit 30. The head unit 30 provided for each ink color has substantially the same configuration with each other. Herein, the clear ink head unit 30Cl will be described as a representative. As shown in FIG. 3, in the head unit 30, the plurality of heads 31 are disposed in a line in a sheet width direction intersecting the transportation direction, and end portions of each head 31 are disposed to be overlapped with each other. The heads 31A and 31B adjacent to each other in the sheet width direction are disposed to be shifted in the transportation direction (disposed in a so-called zigzag shape).

Among the heads 31A and 31B adjacent to each other in the sheet width direction, the head 31A on the downstream side in the transportation direction is called a "downstream side head 31A" and the head 31B on the upstream side in the transportation direction is called an "upstream side head 31B". The heads 31A and 31B adjacent to each other in the sheet width direction are collectively called "adjacent heads".

FIG. 3 is a projection view of the nozzles when they are seen from the top of the head. As shown in FIG. 3, nozzle rows for discharging the ink (herein, nozzle row for discharging clear ink Cl) are formed on the lower surface of each head 31. Each nozzle row is configured with 358 nozzles (#1 to #358). The nozzles of each nozzle row are lined up at constant intervals (for example, 720 dpi) in the sheet width direction. In addition, smaller numbers are denoted sequentially from a left side in the sheet width direction with respect to the nozzles belonging to each nozzle row (#1 to #358).

The heads 31A and 31B lined up in the sheet width direction are disposed so that 8 nozzles on an end portion of the nozzle row of each head 31 are overlapped with each other. In detail, 8 nozzles (#1 to #8) on a left side end portion of the nozzle row of the downstream side head 31A and 8 nozzles (#351 to #358) on a right side end portion of the nozzle row of the upstream side head 31B are overlapped with each other, and 8 nozzles (#351 to #358) on a right side end portion of the nozzle row of the downstream side head 31A and 8 nozzles (#1 to #8) on a left side end portion of the nozzle row of the upstream side head 31B are overlapped with each other. As shown in the drawing, portions in which the nozzles are overlapped with each other in the adjacent heads 31A and 31B are called "overlapped region". The nozzles (#1 to #8 and #351 to #358) belonging to the overlapped regions are called "overlapped nozzles".

The respective head units 30 for each ink color are disposed so that the locations of the nozzles having the same nozzle number are overlapped (matched) with each other in the sheet width direction. For example, the nozzle #358 of the upstream side head 31B of the black ink head unit 30K and the nozzle #358 of the upstream side head 31B of the clear ink head unit 30Cl are disposed so as to be overlapped with each other in the sheet width direction. In the embodiment, the respective head units 30 for each ink color are disposed so that the locations of the nozzles having the same nozzle number are overlapped (matched) with each other in the sheet width direction, but they are not limited thereto, and the head units may be disposed so that the locations of the nozzles having the same nozzle number of the head units 30 with the different ink colors are shifted in the sheet width direction. In this case, it is possible to distribute the overlapped regions in the sheet width direction.

By disposing the plurality of heads 31 in the head unit 30 as described above, it is possible to line up the nozzles at equal intervals (720 dpi) over the entire area in the sheet width direction. As a result, it is possible to form the dot row in which the dots are lined up at equal intervals (720 dpi) over a sheet width length.

Figure 4:
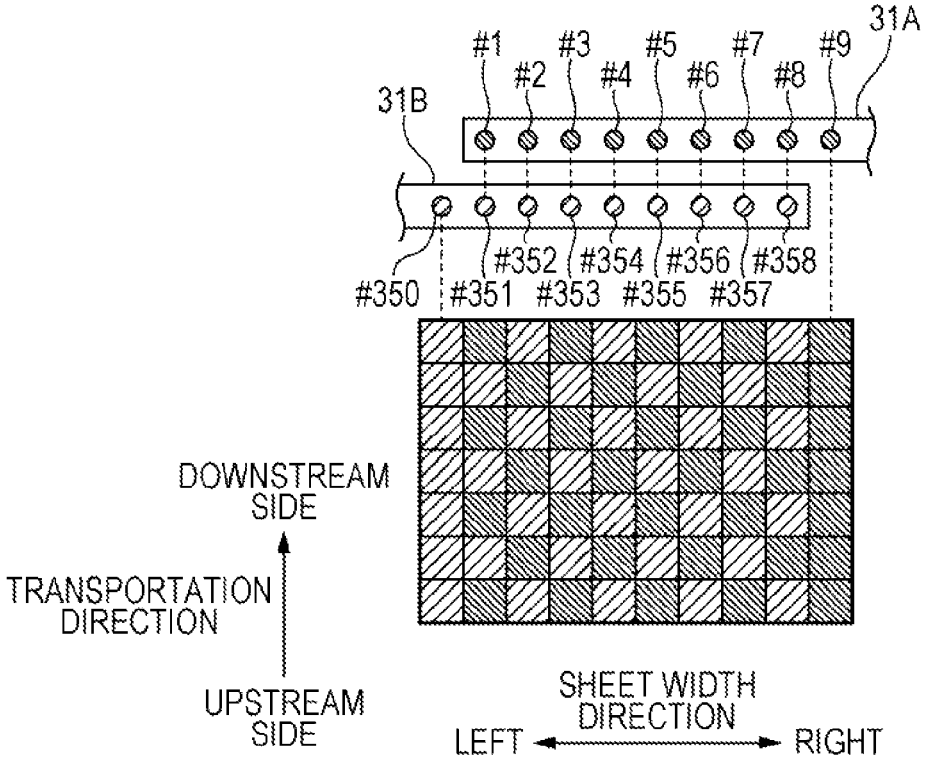
FIG. 4 is a diagram illustrating pixels in which dots are formed by nozzles of a head unit.

FIG. 4 is a diagram illustrating the pixels in which dots are formed by the nozzles of the head units. The drawing shows the nozzle row of the upstream side head 31B and the nozzle row of the downstream side head 31A. The pixels in which the dots are to be formed, are shown in a cell shape on a lower portion of the nozzles. In the drawing, a direction of hatching attached to each nozzle and a direction of hatching of pixels to which the nozzles are allocated for formation of dots, coincide with each other. As shown in the drawing, two nozzles perform the formation of dots in a shared manner in the overlapped region.

Creation Process of Printing Data of Comparative Example

Figure 5:
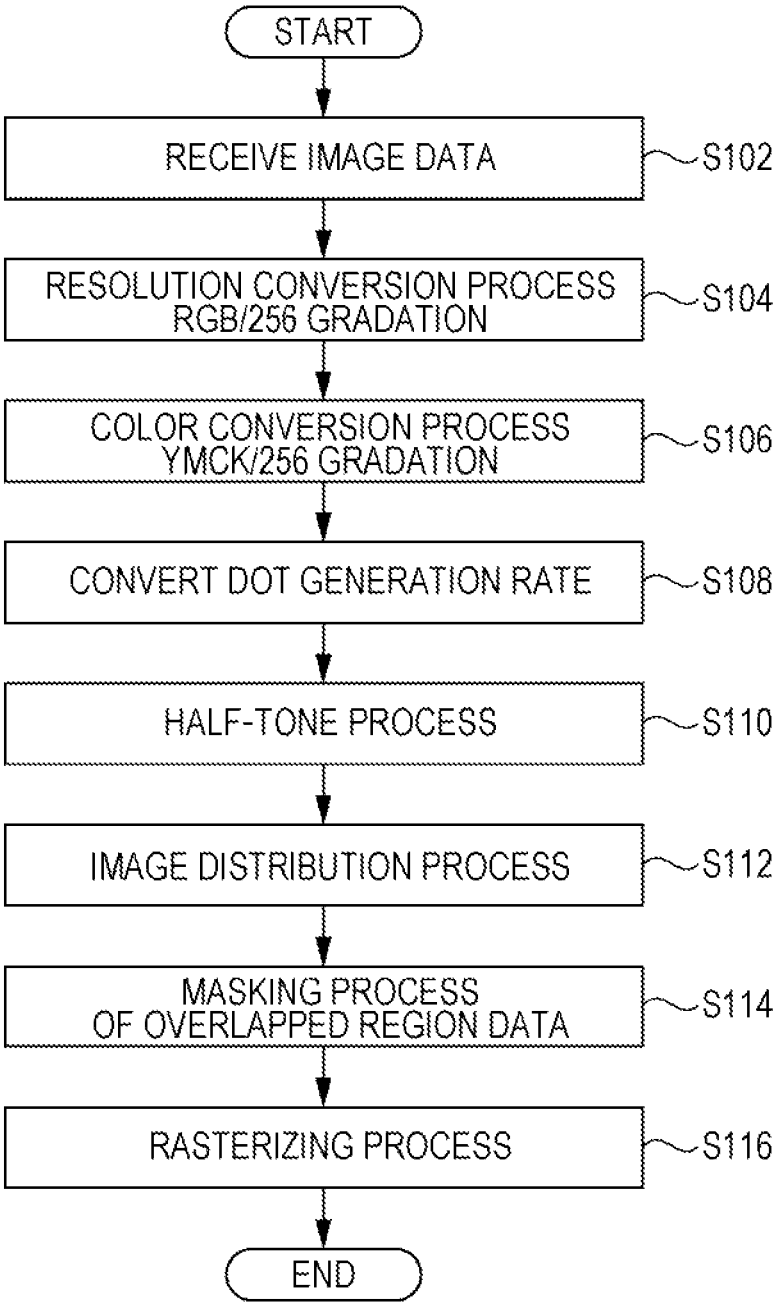
FIG. 5 is a flowchart of a creation process of printing data of a comparative example.
Figure 6:
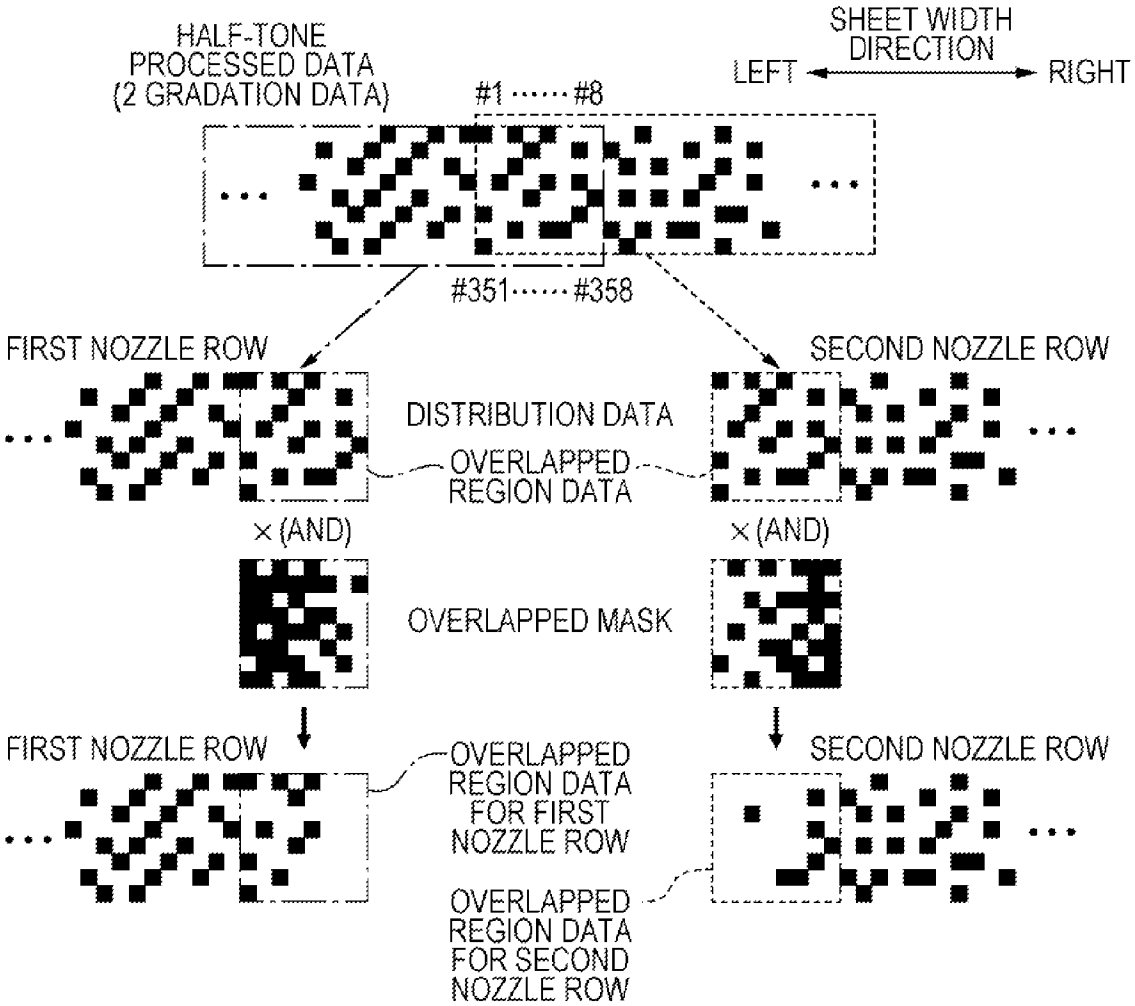
FIG. 6 is a diagram showing allocation of half-tone processed data corresponding to an overlapped region to a nozzle row of an upstream head and a nozzle row of a downstream head.
Figure 7:
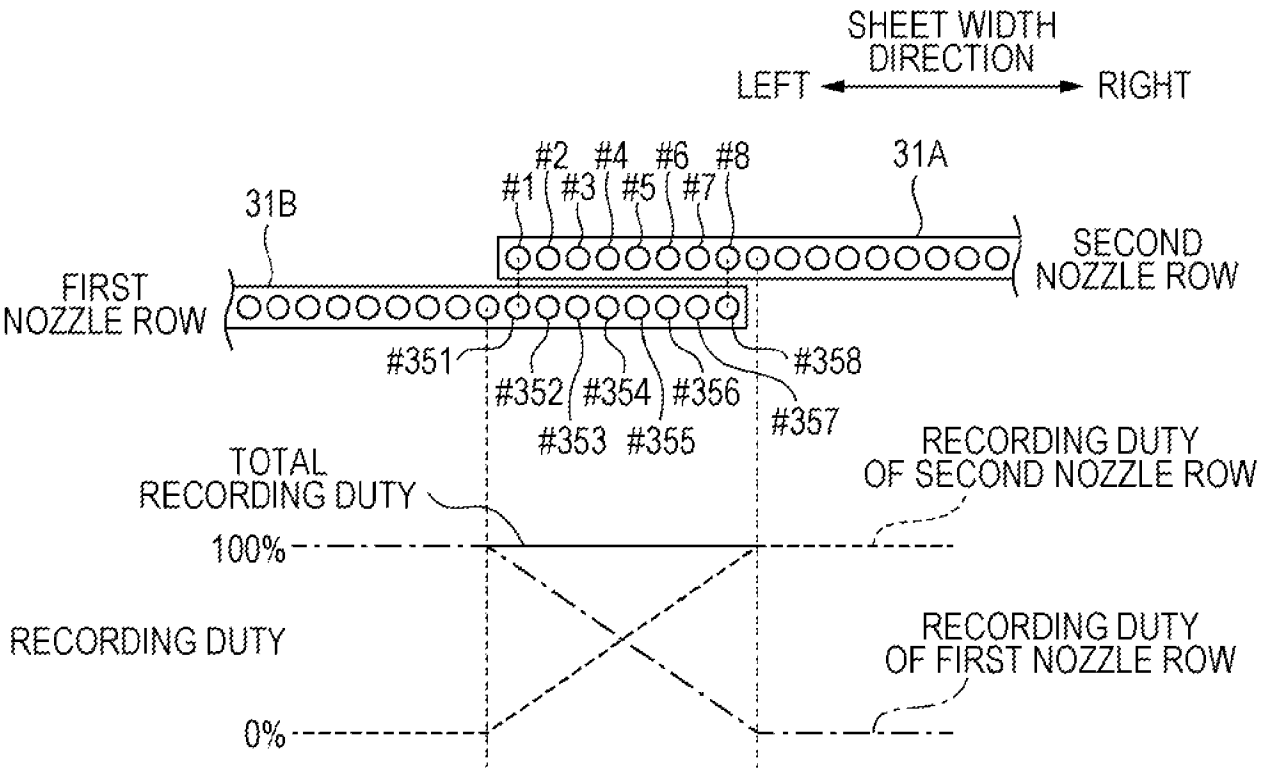
FIG. 7 is a diagram showing recording duties of a first nozzle row and a second nozzle row.

FIG. 5 is a flowchart of a creation process of the printing data of a comparative example, FIG. 6 is a diagram showing allocation of half-tone processed data corresponding to the overlapped region to the nozzle row (hereinafter, referred to as a first nozzle row) of the upstream side head 31B and the nozzle row (hereinafter, referred to as a second nozzle row) of the downstream side head 31A, and FIG. 7 is a diagram showing the recording duties of the first nozzle row and the second nozzle row. Hereinafter, the creation process (comparative example) of the printing data for performing a printing method of the comparative example will be described.

In the printing method of the comparative example, the dots to be formed in the overlapped region are necessarily formed with any one of the overlapped nozzle of the first nozzle row (upstream side head 31B) and the second nozzle row (downstream side head 31A), for obtaining desirable image density. As shown in FIG. 4, for example, in a case where the image data is shown so as to form the dots in all pixels associated with the overlapped region, the dots are formed with respect to all pixels with any one of overlapped nozzle of the first nozzle row and the second nozzle row. The creation process of the printing data for performing such printing is shown below. Herein, the printing data is set to be created by a printer driver which is installed in the computer 100 connected to the printer 1.

As shown in FIG. 5, when the image data is received from various application programs (S102), the printer driver performs a resolution conversion process (S104). The resolution conversion process is a process of converting the image data received from the various application programs to resolution used at the time of performing the printing on a medium S. The image data after performing the resolution conversion process is RGB data having 256 gradations (high gradation) represented by an RGB color space. Accordingly, the printer driver then converts the RGB data into MCK data corresponding to the ink of the printer 1 in a color conversion process (S106).

Next, the printer driver performs a dot generation rate conversion process (S108).

Figure 8:
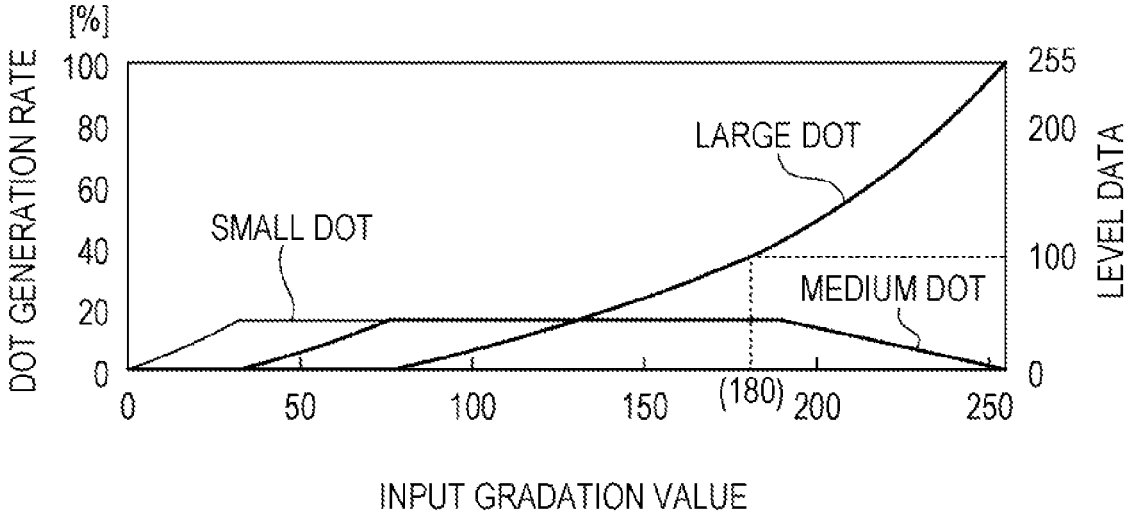
FIG. 8 is a diagram showing a dot generation rate conversion table.

FIG. 8 is a diagram showing a dot generation rate conversion table. In the dot generation rate conversion process, the printer driver applies the gradation value of each pixel to the dot generation rate conversion table and performs conversion to generate dots having a certain dot size at corresponding degree of generation rate. For example, in a case where the input gradation value (hereinafter, may simply be referred to as the "gradation value") is "180", it is found that a generation rate of a large dot is approximately 40%, a generation rate of a medium dot is approximately 20%, and a generation rate of a small dot is approximately 20%. Herein, level data corresponding to the dot generation rate is shown. That is, the level data can be the dot generation rate obtained by replacing the dot generation rate to the 256 gradations. The fact that the level data is "100" when the dot generation rate is approximately 40%, is read from FIG. 8.

Such a dot generation rate conversion process is performed for each pixel. That is, the selected dot size and the level data (dot generation rate) of the size thereof are obtained for each pixel.

Next, the printer driver performs the half-tone process (S110). In the half-tone process, the dither mask (may be referred to as a "dither matrix") is applied to compare the level data described above and a value of a cell of the dither mask, and in a case of including the level data having a value greater than the value of the cell, the dot thereof is determined to be formed. In contrast, in a case of including the level data having a value equal to or less than the value of the cell, the dot thereof is determined not to be formed. With the half-tone process, the data showing generation or non-generation of the dot in each pixel for each dot size is obtained.

Next, the printer driver distributes the half-tone processed data to the overlapped nozzles (#351 to #358) of the first nozzle row and the overlapped nozzles (#1 to #8) of the second nozzle row in an image distribution process (S112). The distribution is performed for each dot size.

The process from Step S108 to Step S116 are performed for each ink color of YMCK, and the same process is also performed for the white ink W and the clear ink Cl.

The drawing on the top of FIG. 6 is data showing generation or non-generation of large dots after the half-tone process. Black squares represent pixels which form the large dots and white squares represent pixels which do not form the large dots. The data surrounded by a dashed-dotted line is the half-tone processed data which is allocated to the first nozzle row, and the data surrounded by a dotted line is the half-tone processed data which is allocated to the second nozzle row. The half-tone processed data which is surrounded by the lines in an overlapped manner is the half-tone processed data corresponding to the overlapped region.

The second drawings from the top of FIG. 6 show data items distributed to the first nozzle row and the second nozzle row by the printer driver. However, the overlapped region data items surrounded by the dotted lines are data items allocated to both of the overlapped nozzles of the first nozzle row and the overlapped nozzles of the second nozzle row. Accordingly, if the data is maintained as the state shown in the second drawings from the top of FIG. 6, all of the dots formed by the overlapped nozzles of the first nozzle row and the dots formed by the overlapped nozzles of the second nozzle row are formed to be overlapped with each other. Therefore, the printer driver determines whether to form the dots showing the overlapped region data (half-tone processed data) by the overlapped nozzles of the first nozzle row or by the overlapped nozzles of the second nozzle row. Thus, a masking process (S114) is performed using overlapped mask shown in the third drawings from the top of FIG. 6.

The masking process is performed by acquiring a logical product with the overlapped mask. That is, in a case where the pixel in black as the distribution data and the pixel in black in the overlapped mask are overlapped with each other in the pixel, the large dots are set to be formed in the pixel thereof. The overlapped mask used herein is generated based on the recording duty of FIG. 7 and is a mask with the low dot generation rate as that in the end portion of the nozzle row.

After specifying the dot of the pixel to which the each nozzle row is allocated for formation, by the masking process (S114) with respect to the overlapped region data as described above, the printer driver rearranges the image data items in a matrix shape in order to be transferred to the printer 1 by a rasterizing process (S116). The printer driver transmits the data which is subjected to the processes are transmitted to the printer 1 with command data in accordance with the printing method. The printer 1 performs the printing based on the received printing data.

In such a so-called line head type printer, the overlapped region of the nozzle rows is affected by an installation error of the head or a transportation error of the medium, and deviation of the landing locations of the ink discharged by the upstream nozzle and the ink discharged by the downstream nozzle occurs. If such deviation of the landing locations occurs, the difference in gloss between the overlapped region and the non-overlapped region occurs, and lines may be seen. Such a difference in gloss is not desirable and therefore the difference in gloss is required to be decreased as much as possible. As a method of decreasing the difference in gloss due to the deviation of the landing locations, there is a method of increasing the ink discharging amount in the overlapped region to improve the filled degree of the dot.

Figure 9:
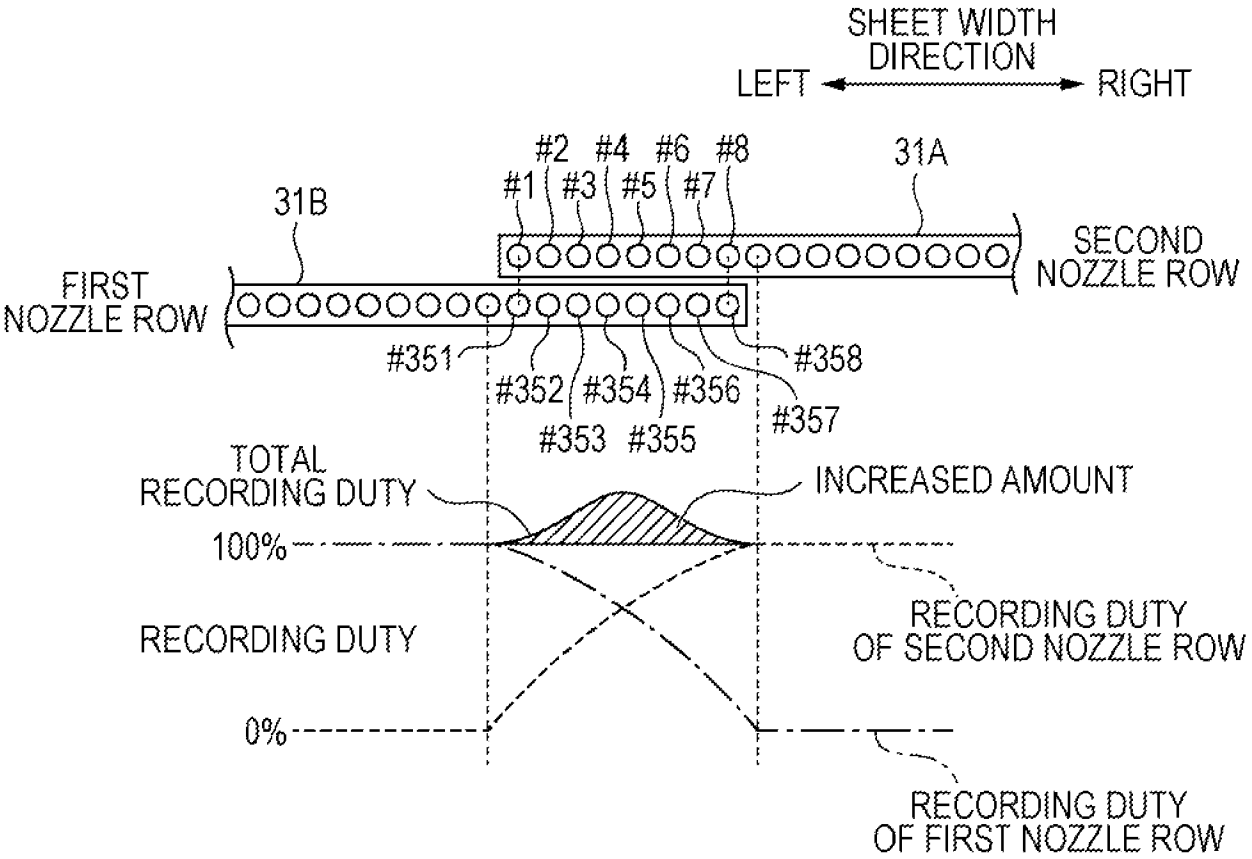
FIG. 9 is an explanatory diagram of recording duties.

FIG. 9 is an explanatory diagram of the recording duty. FIG. 9 shows the recording duty for each nozzle row and a total recording duty. The recording duty is a rate of increase of the ink when the discharging rate of the ink corresponding to the input gradation value is set to a reference. In FIG. 9, the recording duty in the non-overlapped region is 100%, but the total recording duty in the overlapped region exceeds 100%. In the embodiment, since the recording duty in the non-overlapped region is 100%, the discharging amount of the ink with respect to the input gradation value is not particularly corrected. In contrast, since the recording duty in the overlapped region exceeds 100%, the discharging amount of the ink is corrected so as to be increased.

FIG. 10 is a table showing quality of the image in the overlapped region. The drawing shows the input gradation value in the overlapped region (expressed by percentages), and the increased amount of the ink discharging amount in the overlapped region at that time. In FIG. 10, "A" shows a case where the difference in gloss between the overlapped region and the non-overlapped region is not sensed by a visual sense of a person, "B" shows a case where the difference in gloss between the overlapped region and the non-overlapped region is slightly sensed by the visual sense of a person, and "C" shows a case where the difference in gloss between the overlapped region and the non-overlapped region is sensed by the visual sense of a person.

The increased amount of the ink in the overlapped region is shown from A1 to A8, but the increased amount is set to become larger from A1 to A8. When referring to FIG. 10, when the input gradation value is low (when the density is low), the increased amount in the overlapped region is set to a level about from A1 to A4 to not have a substantially increased amount of the ink, so that the difference in gloss is not sensed.

On the other hand, as the input gradation value increases (density increases), the increased amount of the ink in the overlapped region is necessary to be increased from A5 to A8 to set the difference in gloss to not be sensed. As described above, from FIG. 10, it is found that it is difficult to decrease the difference in gloss by simply having a large increased amount of the ink without considering the input gradation value in the overlapped region.

Accordingly, in the embodiment shown below, the increased amount of the ink is changed depending on the input gradation value in the overlapped region, and thus it is difficult to sense the difference in gloss with any input gradation values.

Embodiment

Figure 11:
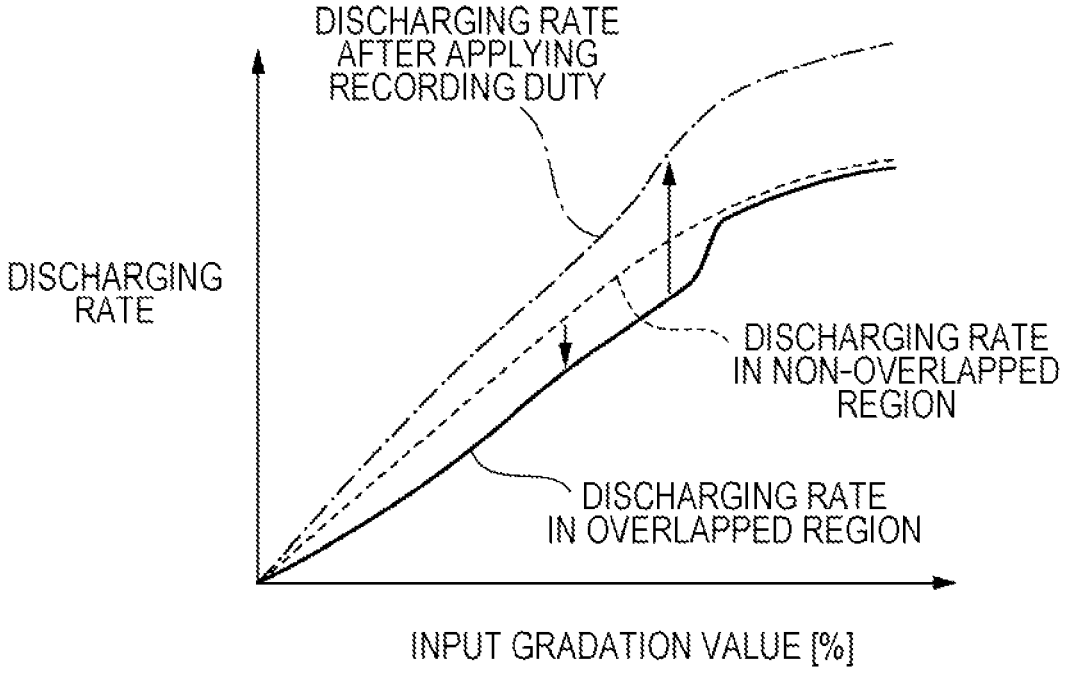
FIG. 11 is an explanatory diagram of a discharging rate.

FIG. 11 is an explanatory diagram of the discharging rate. Hereinafter, the concept of the embodiment will be described with reference to FIG. 11. FIG. 11 shows that the input gradation value is set as a horizontal axis and the discharging rate is set as a vertical axis.

Herein, a discharging rate R of the embodiment is defined as described below.

$R$=((number of times of recording large dots×(ink weight of large dots/ink weight of large dots)+(number of times of recording medium dots×(ink weight of medium dots/ink weight of large dots)+(number of times of recording small dots×(ink weight of small dots/ink weight of large dots))/(maximum number of times of recording which allows recording by 1 head per 1 square inch)×100

Herein, the "number of times of recording" is the number of times of recording of dots with each dot size per 1 square inch. In the embodiment, since the printing with 720 dpi is performed, the 720×720 dots can be formed with 1 head per 1 square inch at most (this is defined as the maximum number of dots to be formed). The number of times of recording the dots with each dot size by 1 head per 1 square inch can be acquired by multiplying the maximum number of dots to be formed by the dot generation rate acquired from FIG. 8.

When the maximum value of the weight of the ink to be recorded in 1 pixel by 1 head is set to 100%, the discharging rate R corresponds to rate of the weight of the ink to be discharged by 1 head in the 1 pixel based on the dot generation rate acquired from FIG. 8, for the input gradation value with respect to 1 pixel.

For example, when the discharging rate is 100%, all of the pixels in the unit area thereof (for example, 1 square inch) are filled with the large dots. By applying the dither mask which will be described later, the ink with the dot generation rate which will be described later is stochastically discharged or not discharged, but when acquiring an average per a certain unit area, the dot generation rate has a relationship corresponding to the discharging rate. Accordingly, the dot generation rate with respect to the input gradation value corresponds to the discharging rate.

In the embodiment, as will be described later, the corrected level data is acquired by multiplying the recording duty by the level data (equivalent to the dot generation rate). The ink is discharged based on the corrected level data. As described above, it is required to differentiate the increased amount of the ink with every input gradation value in the overlapped region. Herein, in a case of applying the same recording duty to any discharging rate, if the increased amount of the ink with the hatching of FIG. 10 can be obtained without changing the recording duty, it is possible to cause the difference in gloss between the overlapped region and the non-overlapped region not to be noticed in the printing with any input gradation value.

Herein, in the embodiment, while the same recording duty is applied regardless of the input gradation value, the discharging rate in the overlapped region (solid line of FIG. 11) with the specified input gradation value is set to be lower than the discharging rate in the non-overlapped region (dashed line of FIG. 11). After that, the correction of increasing the discharging rate with the recording duty in the overlapped region is performed. The discharging rate is adjusted (dashed-dotted line of FIG. 11) so that the increased amount of the ink becomes the increased amount of the ink with the hatching of FIG. 10.

Next, the specific method of the embodiment will be described.

Figure 12:
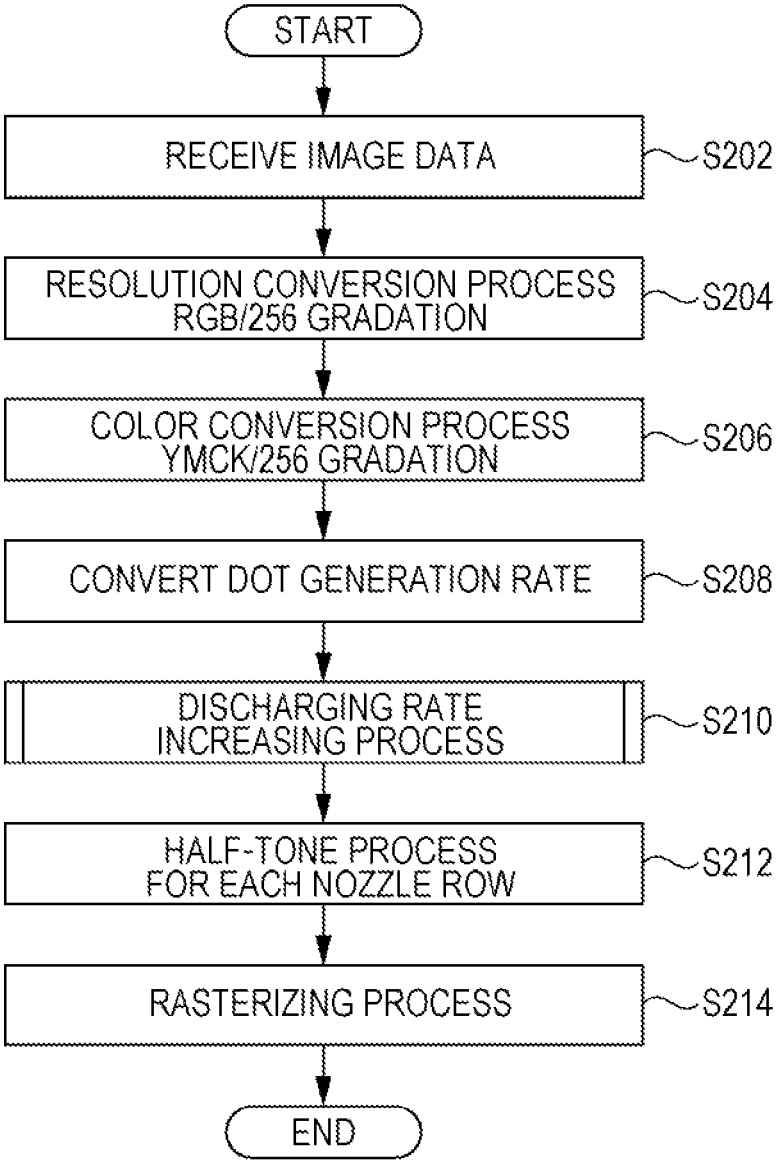
FIG. 12 is a flowchart of printing data creation of the embodiment.

FIG. 12 is a flowchart of a creation process of the printing data of the embodiment. If the image data is received from the application software (S202), the printer driver in the computer 100 connected to the printer 1 performs the resolution conversion process (S204), the color conversion process (S206), and the dot generation rate conversion process (S208), in the same manner as the creation process of the printing data of the comparative example.

The processes from Step S202 to Step S208 are the same as those from Step S102 to Step S108 of FIG. 5 described above. However, data shown with solid lines in FIG. 13 is used for the dot generation rate conversion table in the overlapped region of the embodiment.

Figure 13:
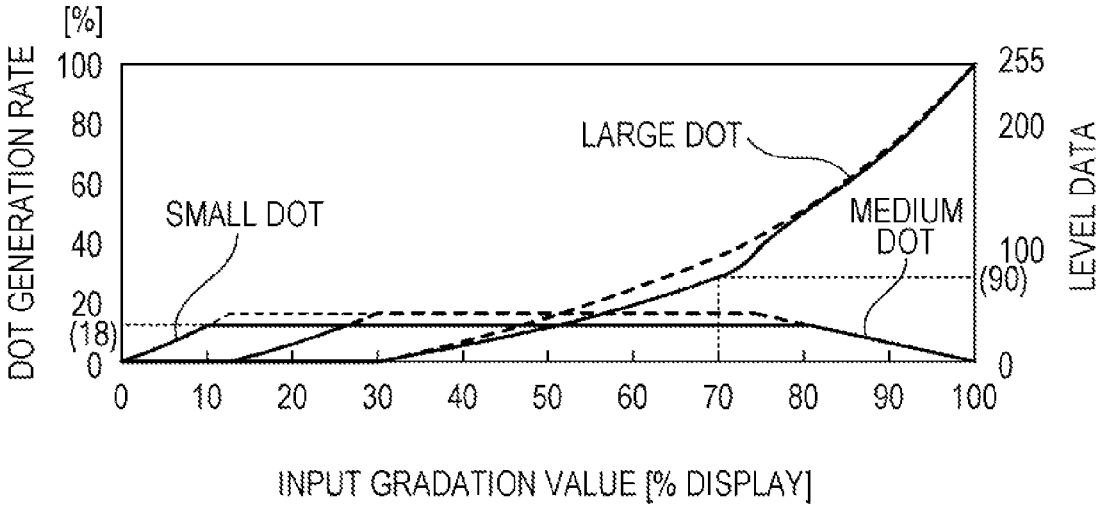
FIG. 13 is a diagram showing a dot generation rate conversion table in an overlapped region.

FIG. 13 is a diagram showing the dot generation rate conversion table in the overlapped region. In FIG. 13, the dot generation rate conversion table of FIG. 8 is shown with a dashed line, and the dot generation rate conversion table in the overlapped region is shown with a solid line. That is, the dot generation rate conversion table shown with the solid line in FIG. 13 is the dot generation rate conversion table applied to the overlapped region, and the dot generation rate conversion table shown with the dashed line is the dot generation rate conversion table applied to the non-overlapped region. In FIG. 13, the input gradation value is expressed by percentages (thus can be converted to the input gradation value by multiplying 255), and the dot generation rate in the overlapped region is further decreased compared to the dot generation rate in the non-overlapped region, in a range of the input gradation value from 10% to 80%. The method of acquiring the dot generation rate conversion table shown in FIG. 13 will be described later.

Herein, the input gradation value for each pixel is 70% (corresponding to the input gradation value which is approximately 180). When referring to FIG. 13, when the input gradation value is 70%, the level data is "90" in the overlapped region whereas the level data is "100" in the non-overlapped region (FIG. 15 which will be described later).

When the conversion of the dot generation rate (S208) ends, the printer driver performs a discharging rate increasing process (S210).

Figure 14:
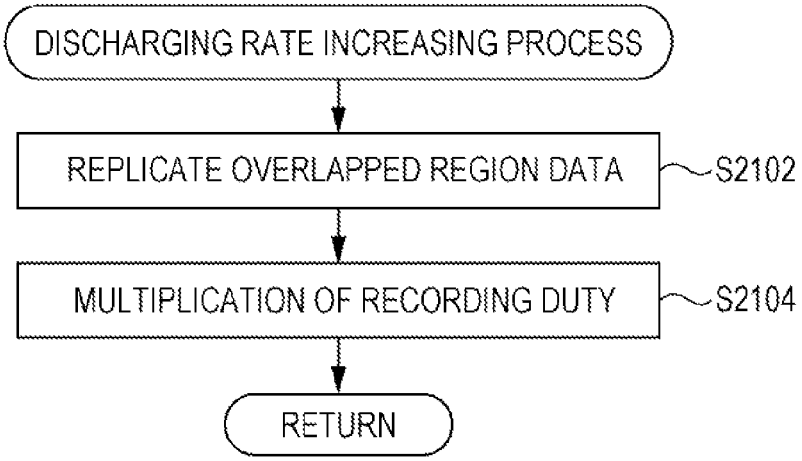
FIG. 14 is a flowchart of a recording duty increasing process.

FIG. 14 is a flowchart of the discharging rate increasing process. In the discharging rate increasing process, first, the replicating of the data in the overlapped region is performed (S2102).

Figure 15:
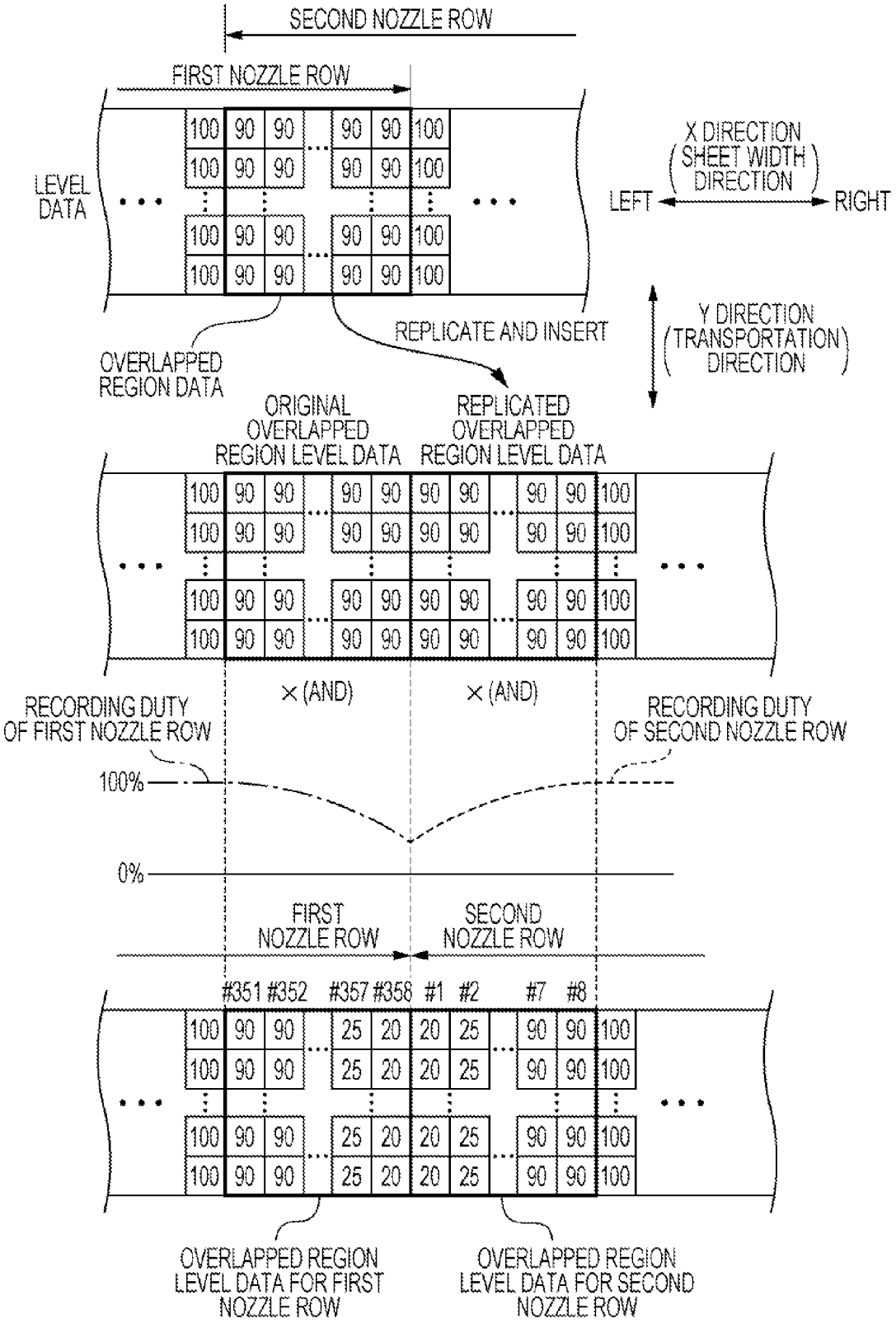
FIG. 15 is a diagram showing an operation of replicating data in an overlapped region and multiplying a recording duty of each nozzle row by overlapped region data.

FIG. 15 is a diagram showing an operation of replicating the data in the overlapped region and multiplying the recording duty of each nozzle row by the overlapped region data (level data). The drawing on the top of FIG. 15 is a diagram showing the level data obtained by the dot generation rate conversion (S210) described above.

Herein, the generation rate of the large dots associated with the first nozzle row (nozzle row of the upstream side head 31B) and the second nozzle row (nozzle row of the downstream side head 31A) is shown as the level data. 1 square in the drawing corresponds to 1 pixel, and the number shown in the pixel is the level data of the large dots of the pixel. Herein, for convenience of description, the value of the level data corresponding to the generation rate of the large dot is shown in each corresponding pixel, but by performing the dot generation rate conversion, the data of the small dot and the medium dot are also generated.

The level data items of the pixels surrounded with a thick line are the level data items corresponding to the overlapped region of the first nozzle row and the second nozzle row. As shown in the drawing, a direction corresponding to the sheet width direction is set as an X direction and a direction corresponding to the transportation direction is set as a Y direction. The printer driver replicates the overlapped region data. The result thereof is the data shown as the second drawing from the top of FIG. 15, and two overlapped region data items are arranged in the X direction.

Next, the printer driver multiplies the recording duty of each nozzle row by the two overlapped region data items (S2104). The data shown in the lowermost data of FIG. 15 is the result obtained by multiplying the recording duty of each nozzle row by the overlapped region data. In FIG. 15, a dashed-dotted line shows the recording duty of the first nozzle row and a dashed line shows the recording duty of the second nozzle row.

The recording duty changes depending on the locations of the overlapped nozzles. As shown in the third drawings from the top of FIG. 15, in the recording duty of the first nozzle row, the recording duty is higher for the nozzle on the first nozzle row side (left side) among the overlapped nozzles and the recording duty is gradually decreased. In contrast, in the recording duty of the second nozzle row, the recording duty is lower for the nozzle on the first nozzle row side (left side) among the overlapped nozzles and the recording duty is gradually increased. In the overlapped region, the total of the recording duty of the first nozzle row and the recording duty of the second nozzle row is constantly the recording duty exceeding 100%. Accordingly, if the same input gradation value is used, the total of the level data of the first nozzle row and the second nozzle row in the overlapped region is constantly higher than the level data in the non-overlapped region.

The pixel (row) on the leftmost side of the original data in the overlapped region is the data allocated to the nozzle #351 of the first nozzle row, and the pixel (row) on the leftmost side of the replicated data in the overlapped region is the data allocated to the nozzle #1 of the second nozzle row. The recording duty of the nozzle #351 of the first nozzle row is set to 100%, the recording duty of the nozzle #1 of the second nozzle row is set to 22%, and the level data of the pixel before distribution is set to "90". In this case, as shown in the lowermost portion of FIG. 15, the level data allocated to the nozzle #351 of the first nozzle row is set to "90" with 100% of the value of 90, and the level data allocated to the nozzle #1 of the second nozzle row is set to "20" with 22% of the value of 90. Accordingly, the total level data of the two nozzles is set to "110" and is set to be higher than the level data "100" in the non-overlapped region. By doing so, the discharging amount of the ink in the overlapped region is set to be greater than the discharging amount of the ink in the non-overlapped region.

By doing so, when the multiplication process of the recording duty (S2104) ends, the half-tone process (S212) is performed for each nozzle row.

Figure 16A:
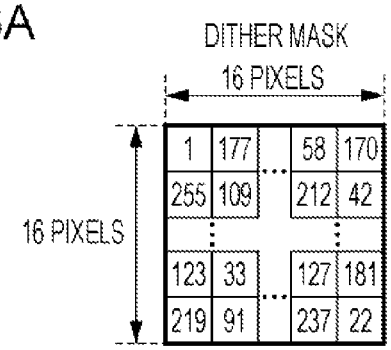
FIG. 16A is a diagram showing a dither mask and FIG. 16B is a diagram showing an operation of a half-tone process performed by a dither method.
Figure 16B:
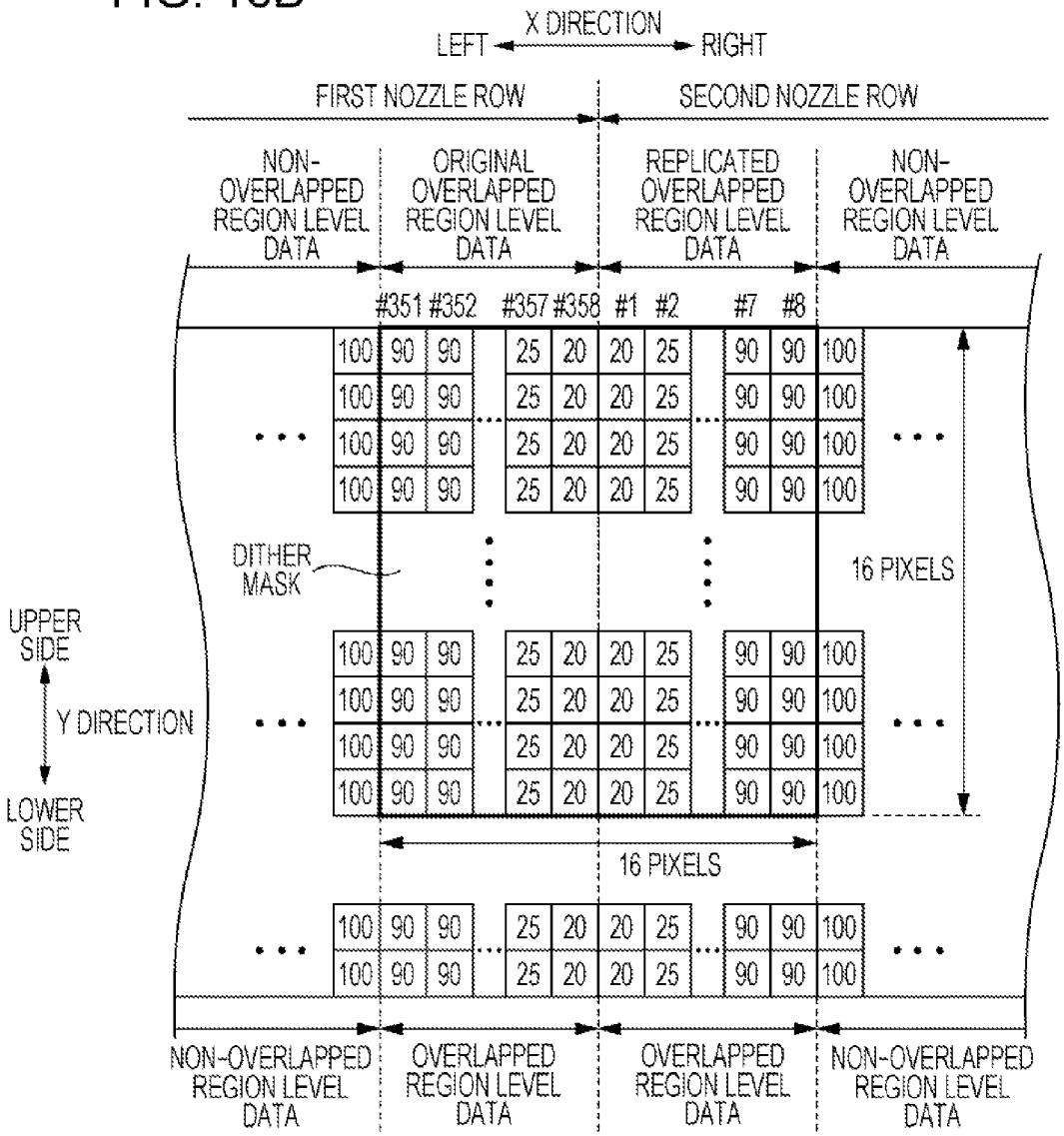

FIG. 16A is a diagram showing the dither mask and FIG. 16B is a diagram showing an operation of the half-tone process performed by the dither method. The dither method is a method of determining formation or non-formation of the dots based on a magnitude relationship between a threshold value stored in the dither mask and the level data shown by each pixel. According to the dither method, it is possible to generate the dots at density corresponding to the level data shown by the pixel, for each unit area to which one dither mask is allocated. In addition, according to the dither method, it is possible to disperse and generate the dots by the setting of the threshold value of the dither mask and to improve a granularity of the image.

In particular, the dither mask used in the embodiment is a mask having a blue noise property or a green noise property. The blue noise property and the green noise property will be described later, but since a storage location of the threshold value is adjusted so as to generate a great frequency component in a high frequency range, it is possible to further cause the difference in gloss not to be noticed in the overlapped region by a visual sense of a person.

FIG. 16B shows the location at which the dither mask (thick line) is associated with the non-overlapped region data and the overlapped region data of the first nozzle row and the second nozzle row. The printer driver associates the dither mask with the level data of the high gradation (256 gradations) in order from the left in the X direction and top in the Y direction, and determines the formation or non-formation of the large dots by comparing a target pixel and a threshold value of the dither mask corresponding thereto. In the determination of the formation of the large dots, it is determined to form the large dots in a case where the level data of the target pixel is greater than the threshold value of the dither mask.

Herein, the example of the large dots has been described, but the same processes are also performed for the small dots and the medium dots. The dither mask shown in FIG. 16A is configured with 16 pixels×16 pixels, but a dither mask having another size may be used. In the embodiment, the half-tone process is performed by using the dither method, but another half-tone process such as an error diffusion method may be performed.

Lastly, the rasterizing process (S214) is performed. The rasterizing process is the same process performed in the method of the comparative example described above. The printer driver transmits the data which is subjected to the processes to the printer 1 with command data in accordance with the printing method. The printer 1 performs the printing based on the received printing data.

Next, a method of acquiring the dot generation rate conversion table in the overlapped region will be described. The dot generation rate in the overlapped region shown in FIG. 13 described above is acquired by multiplying a coefficient α (0 to 1) by the dot generation rate in the non-overlapped region at the time of using a certain input gradation value. For example, in FIG. 13, α when the input gradation value is 40% is set to 0.9. The dot generation rate (medium dot) in the non-overlapped region at the time of using 40% of input gradation value is 20%, and by multiplying α thereby, it is possible to acquire 18% as the dot generation rate (medium dot) in the overlapped region. Hereinafter, a method of acquiring a will be described using the time when the input gradation value is 40% as an example.

Figure 17A:
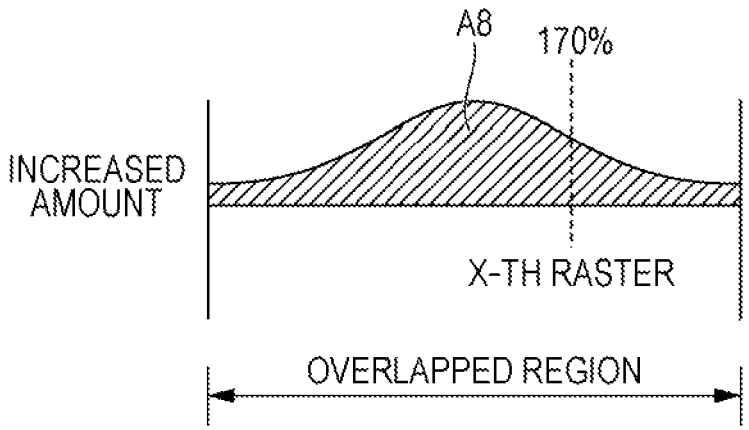
FIG. 17A is an explanatory diagram of an increased amount of ink when an input gradation value is 100% and FIG. 17B is an explanatory diagram of an increased amount of ink when an input gradation value is 40%.
Figure 17B:
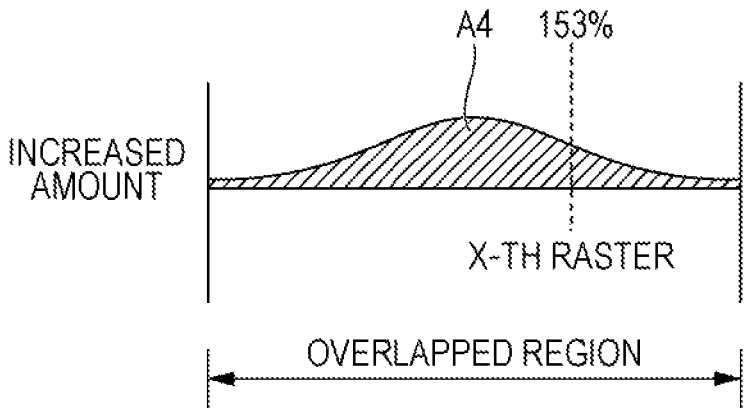

FIG. 17A is an explanatory diagram of the increased amount of the ink when the input gradation value is 100%. FIG. 17B is an explanatory diagram of the increased amount of the ink when the input gradation value is 40%. The increased amount of the ink of FIG. 17A is the increased amount corresponding to A8 of FIG. 10. In addition, the increased amount of the ink of FIG. 17B is the increased amount corresponding to A4 of FIG. 10, and a which is set as the increased amount thereof in the final stage (desired increased amount) is set to be acquired. In the embodiment, the recording duty is acquired so that the increased amount of the ink when the input gradation value is 100% is A8. Accordingly, the increased amounts of the ink at the time of using the other input gradation values are determined by using the increased amount of the ink when the input gradation value is 100% as a reference.

In FIG. 17A, it is assumed that the increased amount of an X-th raster is 170%. In FIG. 17B, it is assumed that the increased amount of an X-th raster is 153%. α at that time is set to satisfy α=153/170=0.9. That is, a value obtained by dividing the increased amount of the raster at the time of using the desired increased amount by the increased amount of the raster when the ink amount is most increased, is set to α.

By doing so, α corresponding to each input gradation value is acquired. In addition, by multiplying α by the dot generation rate in the non-overlapped region, it is possible to acquire the dot generation rate in the overlapped region.

Figure 18A:
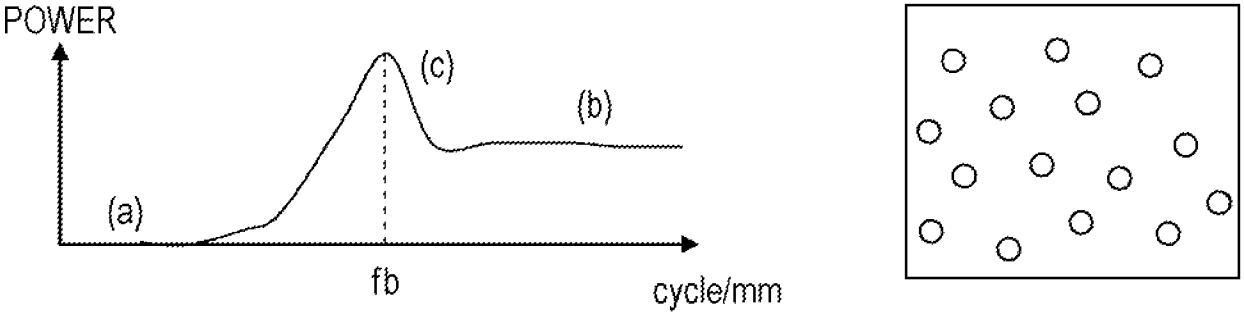
FIG. 18A is an explanatory diagram of a spatial frequency property of a blue noise property and FIG. 18B is an explanatory diagram of a spatial frequency property of a green noise property.

FIG. 18A is an explanatory diagram of a spatial frequency property of the blue noise property. In the dot disposition having the blue noise property, respective dots are disposed to be disordered or to be uniform. If the half-tone process is performed with respect to the input image having the constant gradation using the dither mask having the blue noise property, the frequency of the dot disposition has the following properties.

(a) A low frequency component is substantially or completely not included.

(b) A flat and smooth high frequency range is included.

(c) A main frequency which is generally shown by the following formula is included.

$$f_b = \begin{cases} \dfrac{\sqrt{g}}{D} & (0 < g \leq 1/2) \\ \dfrac{\sqrt{(1-g)}}{D} & \left(\dfrac{1}{2} < g \leq 1\right) \end{cases}$$

Herein, D is a minimum distance between the dots, and g is a gray level (g=gradation value/255).

Figure 18B:
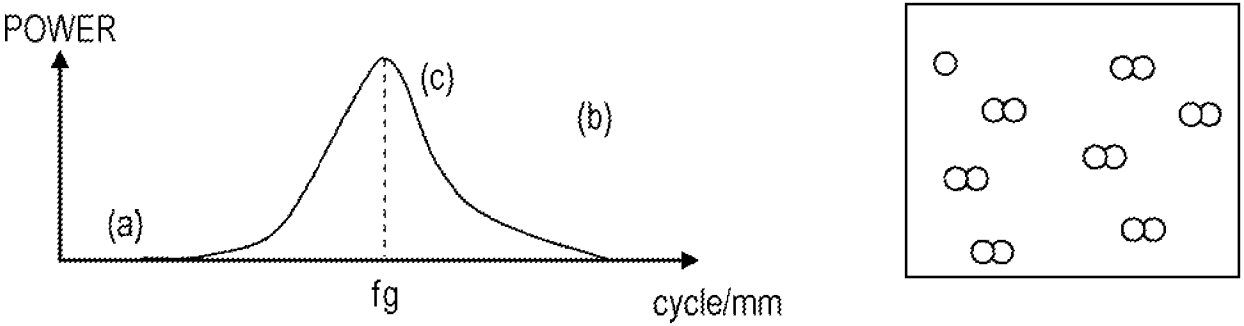

FIG. 18B is an explanatory diagram of a spatial frequency property of the green noise property. In the dot disposition having the blue noise property, clusters of the dots are disposed to be disordered or to be uniform. If the half-tone process is performed with respect to the input image having the constant gradation using the dither mask having the green noise property, the frequency of the dot disposition has the following properties.

(a) A low frequency component is substantially or completely not included.

(b) The frequency decreases as the cluster of the dot increases.

(c) A main frequency which is generally shown by the following formula is included.

$$f_b = \begin{cases} \dfrac{\sqrt{g/\overline{M}}}{D} & \left(0 < g \leq \dfrac{1}{2}\right) & M \text{ IS AN AVERAGE SIZE OF A CLUSTER OF PIXELS WHEN DOT IS ON} \\ \dfrac{\sqrt{(1-g)/\overline{M}}}{D} & \left(\dfrac{1}{2} < g \leq 1\right) & M \text{ IS AN AVERAGE SIZE OF A CLUSTER OF PIXELS WHEN DOT IS OFF} \end{cases}$$

Herein, D is a minimum distance between the dots, and g is a gray level (g=gradation value/255).

Other Embodiment

In the embodiment described above, the level data when the input gradation value is low in the overlapped region is set to be lower than that in the non-overlapped region, but the embodiment is not limited thereto. For example, the level data when the input gradation value is high in the overlapped region is set to be lower than that in the non-overlapped region, the level data when using the half-tone input gradation value may be set to lower than that in the non-overlapped region.

In FIG. 11, the discharging rate in the overlapped region is set to be further decreased from the discharging rate in the non-overlapped region in a partial range of the input gradation value, but the embodiment may be set as described below. That is, the predetermined times of the discharging rate is acquired by multiplying a predetermined coefficient by the discharging rate in the non-overlapped region. The acquired value can be set as the discharging rate in the overlapped region so that the discharging rate is decreased more than the predetermined times of the discharging rate in the partial range of the input gradation value.

The embodiment described above is for easily illustrating the invention and is not for limiting the invention. Modifications and improvements may be performed within a range not departing from a gist of the invention and equivalent materials as those in the embodiment may be included in the invention. Particularly, the following embodiment is included in the invention.

Printer

In the embodiment described above, the example of the printer (so-called line head printer) which forms an image by lining up the plurality of heads over the sheet width length and transporting the sheet under the fixed heads, is used, but it is not limited thereto. For example, the plurality of heads are lined up in a nozzle row direction so that end portions of the nozzle rows of the plurality of heads are overlapped with each other. A printer (so-called serial type printer) which alternately repeats an operation of forming an image while moving the plurality of heads in a direction intersecting with the nozzle row direction, and an operation of transporting the sheet with respect to the plurality of heads in the nozzle row direction, may be used. In this case, in the same manner as in the embodiment described above, it is possible to obtain the printing data by performing the half-tone process of the data obtained by multiplying the recording duty by the dot generation rate data (level data) for each dot size in the overlapped region in which the heads are overlapped with each other.

Liquid Discharging Apparatus

In the embodiment, the ink jet printer is used as the liquid discharging apparatus, but it is not limited thereto. The embodiment can be applied to any industrial apparatus which is not a printer, as long as it is a liquid discharging apparatus. For example, the invention can be applied to a printing apparatus for printing patterns on a fabric, a color filter manufacturing apparatus or a display manufacturing apparatus of an organic EL display, a DNA chip manufacturing apparatus for manufacturing a DNA chip by applying a solution containing dissolved DNA to a chip.

In addition, for the discharging method of the liquid, a piezoelectric method of applying voltage to a driving element (piezoelectric element) and expanding and contracting an ink chamber to discharge the liquid, or a thermal method of generating air bubbles in the nozzles using a heat generation element to discharge the liquid by the air bubbles may be used. The liquid is not limited to the liquid such as the ink and may be powder or the like.

The entire disclosure of Japanese Patent Application No. 2013-071624, filed Mar. 29, 2013 is expressly incorporated by reference herein.

What is claimed is:

1. A liquid discharging apparatus comprising:

a first nozzle row in which nozzles for discharging liquid are lined up in a predetermined direction;

a second nozzle row in which nozzles for discharging liquid are lined up in a predetermined direction, and which is disposed by forming an overlapped region in which an end portion of one side in the predetermined direction is overlapped with an end portion of the other side in the predetermined direction of the first nozzle row; and a control unit which discharges liquid from nozzles in the overlapped region and a non-overlapped region which is a region other than the overlapped region, depending on a discharging rate of liquid acquired based on input data of an image, and a recording duty for discharging the liquid, wherein the control unit, when a value of the input data of the image is at least in a partial range of the input data, obtains a corrected discharging rate which is a discharging rate smaller than a discharging rate in the non-overlapped region with respect to the value of the input data at least in the partial range of the input data, and discharges the liquid from the nozzles of the first nozzle row and the second nozzle row in the overlapped region depending on a value of a correction of increasing the corrected discharging rate with a predetermined recording duty which is a recording duty higher than a recording duty in the non-overlapped region, wherein the nozzles discharge liquid droplets having a plurality of sizes to form dots having a plurality of dot sizes, and the corrected discharging rate is an amount related to a dot generation rate for each dot size, wherein, to further decrease the discharging rate in the overlapped region than that in the non-overlapped region at least in a partial range of the input data, is to further decrease the dot generation rate for each dot size in the overlapped region than that in the non-overlapped region at least in a partial range of the input data.

2. The liquid discharging apparatus according to claim 1, wherein the predetermined recording duty is constant regardless of the value of the input data.

3. The liquid discharging apparatus according to claim 1, wherein the liquid is discharged from the nozzles based on dot data obtained by acquiring the corrected dot generation rate and performing a half-tone process with respect to the acquired corrected dot generation rate, the corrected dot generation rate for each dot being calculated by multiplying the dot generation rate for each dot size by a value representative of the recording duty for each dot.

4. The liquid discharging apparatus according to claim 3, wherein a mask having a blue noise property or a green noise property is used as a dither mask of the half-tone process.

5. The liquid discharging apparatus according to claim 1, wherein the discharging rate before acquiring the corrected discharging rate in the overlapped region is the discharging rate acquired by multiplying a predetermined coefficient by the discharging rate in the non-overlapped region.

6. A liquid discharging method for discharging liquid from a liquid discharging apparatus including a first nozzle row in which nozzles for discharging liquid are lined up in a predetermined direction, and a second nozzle row in which nozzles for discharging liquid are lined up in a predetermined direction, and which is disposed by forming an overlapped region in which an end portion of one side in the predetermined direction is overlapped with an end portion of the other side in the predetermined direction of the first nozzle row, the method comprising:

receiving input data of an image;

when a value of the input data of the image is at least in a partial range of the input data, obtaining a corrected discharging rate which is a discharging rate smaller than a discharging rate in the non-overlapped region with respect to the value of the input data at least in the partial range of the input data; and discharging the liquid from the nozzles of the first nozzle row and the second nozzle row in the overlapped region depending on a value of a correction of increasing the corrected discharging rate with a predetermined recording duty which is a recording duty higher than a recording duty in the non-overlapped region, the nozzles discharging liquid droplets having a plurality of sizes to form dots having a plurality of dot sizes, and the corrected discharging rate is an amount related to a dot generation rate for each dot size; and, wherein to further decrease the discharging rate in the overlapped region than that in the non-overlapped region at least in a partial range of the input data by decreasing the dot generation rate for each dot size in the overlapped region than that in the non-overlapped region at least in a partial range of the input data.

7. A liquid discharging apparatus comprising:

a first nozzle row in which nozzles for discharging liquid are lined up in a predetermined direction;

a second nozzle row in which nozzles for discharging liquid are lined up in a predetermined direction, and which is disposed by forming an overlapped region in which an end portion of one side in the predetermined direction is overlapped with an end portion of the other side in the predetermined direction of the first nozzle row; and a control unit which discharges liquid from nozzles in the overlapped region and a non-overlapped region which is a region other than the overlapped region, depending on a discharging rate of liquid acquired based on input data of an image, and a recording duty for discharging the liquid, wherein the control unit, when a value of the input data of the image is at least in a partial range of the input data, obtains a corrected discharging rate which is a discharging rate smaller than a discharging rate in the non-overlapped region with respect to the value of the input data at least in the partial range of the input data, and discharges the liquid from the nozzles of the first nozzle row and the second nozzle row in the overlapped region depending on a value of a correction of increasing the corrected discharging rate with a predetermined recording duty which is a recording duty higher than a recording duty in the non-overlapped region, wherein the liquid is discharged from the nozzles based on dot data obtained by acquiring the corrected dot generation rate and performing a half-tone process with respect to the acquired corrected dot generation rate, the corrected dot generation rate for each dot being calculated by multiplying the dot generation rate for each dot size by a value representative of the recording duty for each dot, wherein a mask having a blue noise property or a green noise property is used as a dither mask of the half-tone process.

* * * * *